US006304721B1

(12) United States Patent
Ericson

(10) Patent No.: US 6,304,721 B1
(45) Date of Patent: Oct. 16, 2001

(54) ARRANGEMENT FOR CREATING HEAT IRRADIATION OF A SURFACE

(75) Inventor: Birger Ericson, Alingsås (SE)

(73) Assignee: Fasadteknik International EFO AB (SE)

( * ) Notice: Subject to any disclaimer, the term of this patent is extended or adjusted under 35 U.S.C. 154(b) by 0 days.

(21) Appl. No.: 09/554,016

(22) PCT Filed: Oct. 19, 1998

(86) PCT No.: PCT/SE98/01867

§ 371 Date: May 9, 2000

§ 102(e) Date: May 9, 2000

(87) PCT Pub. No.: WO99/26797

PCT Pub. Date: Jun. 3, 1999

(30) Foreign Application Priority Data

Nov. 10, 1997 (SE) ..... 9704096

(51) Int. Cl.[7] ..... B44D 3/16; E04G 23/00

(52) U.S. Cl. ..... 392/410; 392/423

(58) Field of Search ..... 392/410–415, 392/424, 425, 422, 423; 34/266, 267, 270, 271, 278

(56) References Cited

U.S. PATENT DOCUMENTS

| | | | | |
|---|---|---|---|---|
| 2,221,318 | * | 11/1940 | Worthing et al. | 392/422 |
| 2,694,135 | * | 11/1954 | Brockmole | 392/423 |
| 3,242,315 | * | 3/1966 | Fannon, Jr. | 392/422 |
| 3,731,055 | * | 5/1973 | Kerchner, Jr. et al. | 392/423 |
| 5,196,674 | * | 3/1993 | Chartrain et al. | 392/424 |
| 5,590,238 | * | 12/1996 | Ericson | 392/412 |
| 5,668,921 | * | 9/1997 | Essler | 392/423 |

FOREIGN PATENT DOCUMENTS 465768 10/1991 (SE) .

* cited by examiner

*Primary Examiner*—John A. Jeffery
(74) *Attorney, Agent, or Firm*—Lerner, David, Littenberg, Krumholz & Mentlik, LLP

(57) ABSTRACT

A radiant heater useful for softening and removing paint from a surface is disclosed. The heater has a main component in the form of a box that opens at one side. The open side allows for heated air to heat a surface. The box has a suction opening and an exhaust opening for removing fumes from the room where the heating is occurring. The box also has longitudinally extending tracks and a partition wall disposed in it. Electrical resistance wires are arranged in the box to provide heating.

18 Claims, 4 Drawing Sheets

ARRANGEMENT FOR CREATING HEAT IRRADIATION OF A SURFACE

TECHNICAL FIELD

The present invention relates to a device for providing heat radiation of a surface which preferably is intended to be radiated for softening and removing old paint or drying of moisture. The heat radiation from the device is intended to be obtained by means of electric resistance wires arranged in an open box.

BACKGROUND OF THE INVENTION

During renovation of wooden surfaces on older houses, it is normally required to remove several coats of successively painted unsightly cracked and flaking oil- and/or plastic-based paint. Various methods are available for executing this work, wherein the removal of the paint for example can be carried out by means of scraping or grinding, which either implies a great effort of costly manpower or diffusion of ecologically harmful dust and disturbing noise. Previously, blow torches have also been utilized in order to burn off paint or rather to soften the paint by means of heating, so that it would be easier to scrape the paint off the wood. Caustic solutions or strong hydrocarbon-based solvents have also been utilized for removal of paint from wooden facades. All of these methods involve various disadvantages.

As a result of this, there has recently been a change to a method which implies that the paint is softened by radiation by means of a source of infra-red radiation. Thereafter, the paint is immediately removed by means of mechanical treatment of the wooden surface. Such a method and a device for execution of this method is described in the swedish patent 9000763-4. Apart from the radiation member, the device according to this patent also consists of members for controlled vertical and horizontal moving of the carrier along the facade, which makes it possible to reach a reasonably plane rectangular surface.

TECHNICAL PROBLEM

Although the known device according to what is described above operates satisfactorily, it is heavy and bulky having a weight in the neighbourhood of 4 kilo, and it is awkward to transport. The construction is relatively complicated and it is therefore costly to manufacture. It can not be minimized or enlarged by removal of components and the utilization is consequently limited to such surfaces which, on the one hand, are suitable for the device and, on the other hand, can be reached by the device.

During heating of surfaces with old paint and similar coatings, an evil-smelling and poisonous smoke is produced which consists of decomposition products of the paint or the other coating and partly of the substrate. Due to the fact that this smoke is warm, it rises and diffuses in the environment, by means of which the smoke constitutes a big environmental problem.

SOLUTION

As a result of this, there has for a long time been a need for developing such a device which, on the one hand, has a low weight, permits mounting on a light and variable suspension device and is adjustable as regards its size and, on the other hand, can be manufactured in an easy and reliable manner and is harmless to the environment. Therefore, according to the invention, a device has been developed for providing heat radiation of a surface, preferably for softening and removing old paint, wherein the heat radiation is intended to be obtained by means of electric resistance wires arranged in a box which opens towards the surface which is intended for treatment, which device is characterized in that the box consists of a main component which is formed by extrusion pressing and which comprises longitudinally extending tracks for mounting of other components forming part of the device, and a lid in each end portion and a longitudinally extending partition wall behind the electric resistance wires.

According to the invention, one of the lids is provided with an exhaust opening which communicates with the space behind the partition wall and the other lid is formed with a suction opening located at the open end portion of the box which communicates with the space behind the partition wall.

According to the invention, it is suitable that the partition wall supports the electric parts.

According to the invention, it is suitable that the partition wall is inserted into longitudinal tracks in the interior wall of the main component.

According to the invention, in order to reinforce the heat radiation and the direction of the radiation, it is suitable that a wave-like reflector is provided in tracks in the interior wall of the main component behind the resistance wires, but in front of the partition wall.

According to the invention, in order to maintain a suitable distance between the device and the surface which is to be treated, and in order to absorb generated smoke more effectively, it is suitable to provide adjustable distance holders towards the surface which is intended for the heat treatment, said distance holders being in the form of displaceable walls and being provided on each side of the opening of the box towards the surface.

Furthermore, according to the invention, it is advantageous to provide tracks on the outside of the backside of the box for insertion and mounting of a handle unit.

According to the invention, in order to adjust the size of the device which is intended to radiate a surface, it is suitable that two or more boxes are coupled together beside each other.

BRIEF DESCRIPTION OF THE DRAWINGS

The invention will be further described in the following with reference to the annexed drawings, in which.

PREFERRED EMBODIMENT

Figure 1:
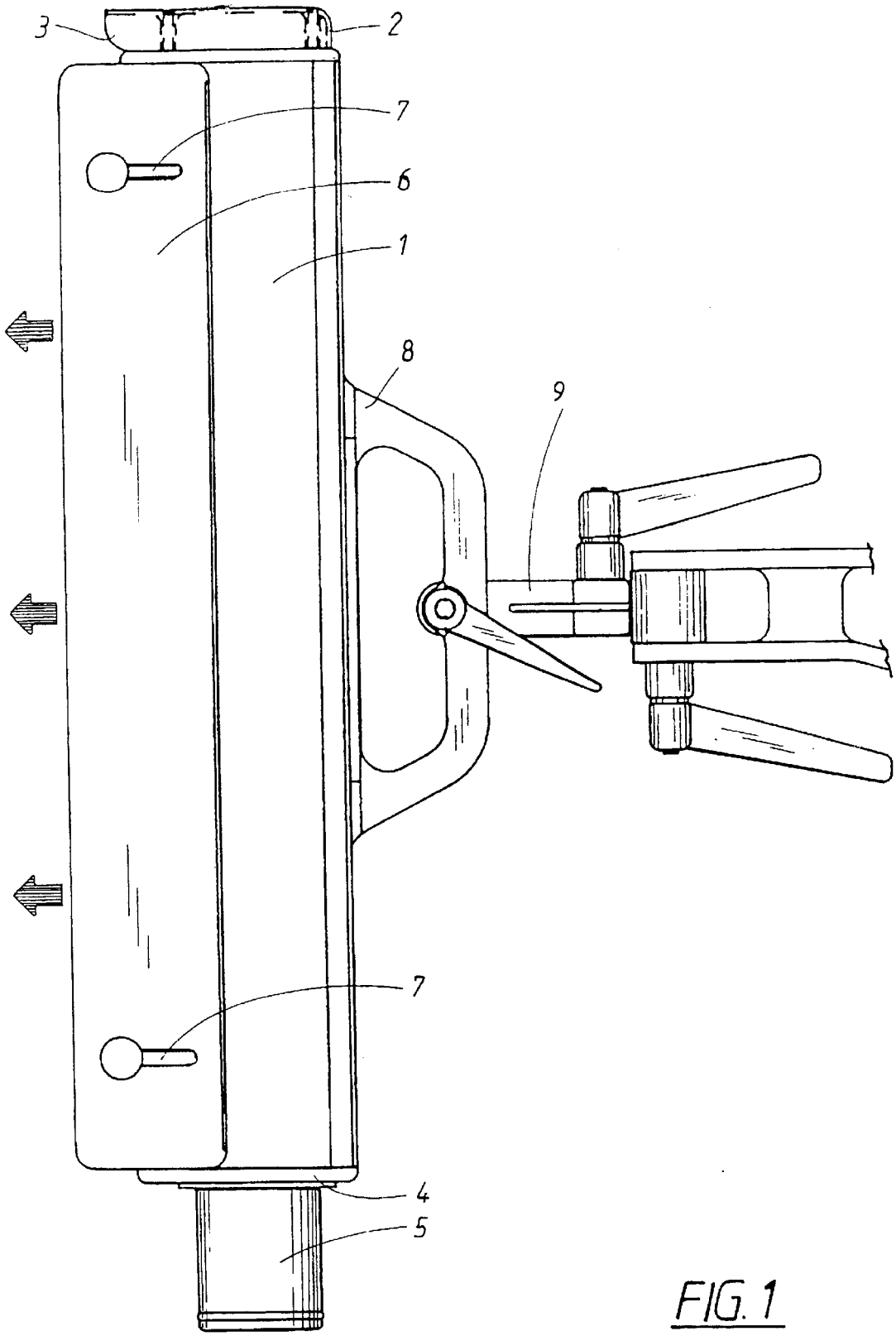
FIG. 1 is a side view of a device according to the present invention.

FIG. 1 shows a side view of a device according to the present invention having a main component 1 which is formed by extrusion pressing and preferably made of aluminium. At its upper end portion, the device is provided with a lid 2 having a suction opening 3 for smoke, and a lower lid 4 which is provided with a tube dowel 5 for connection to a suction device. When the device is utilized, heat radiates from the device to the left in the drawing, as is indicated by the arrows. On each side of the main component 1 towards the surface which is to be treated, two distance holders 6 are provided, one of which, the left in the direction of the radiation, is shown in the drawing. These distance holders 6 are made in the form of wall pieces or plates which are in close contact with the surface being treated and, therefore, they enclose the working surface at the sides. The distance holders 6 are provided with slots 7, so that they can be screwed on by means of these and be moved forwards or backwards. As is apparent, the device according to this drawing is provided with a handle unit 8 which has been inserted into tracks on the backside of the main component. The handle unit 8 is fixed to a supporting arm 9.

Figure 2:
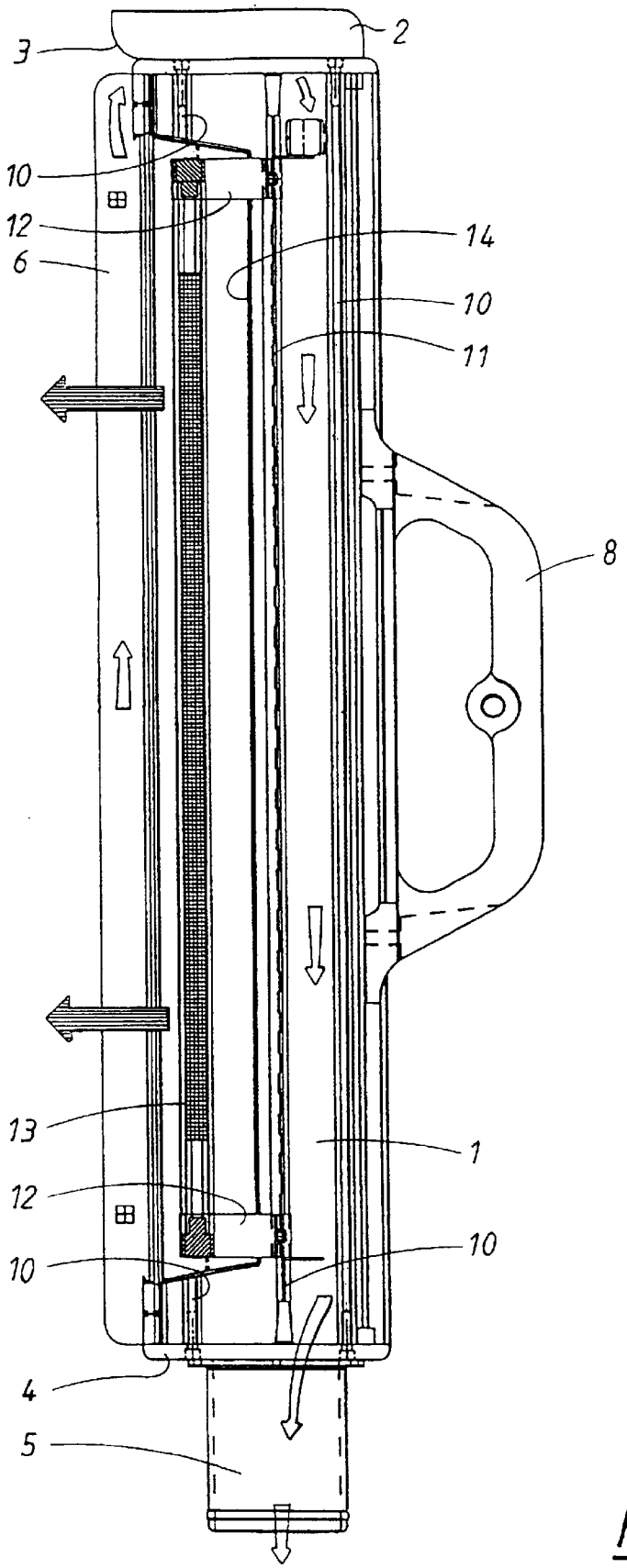
FIG. 2 is a vertical section of the device according to FIG. 1.

FIG. 2 shows a longitudinal section through the device having mounted lids 2 and 4 and a handle 8. Longitudinal tracks 10 are provided on several locations on the inside and the outside of the main component 1. These tracks are constructed in connection with the extrusion pressing and constitute insertion and mounting brackets for various components.

In two of these tracks, one on each side of the main component 1, a partition wall 11 has been inserted. This partition wall 11 supports holders 12 for the electric resistance wires 13. For the sake of clarity, the rest of the electric wires and their suspension has been excluded. The electric resistance wires can, however, be replaced by other electric heating devices, such as microwave devices.

Behind the resistance wires 13 but in front of the partition wall 11, a blank reflector 14 is provided. The reflector 14 is also inserted into a track on the inside of the main component 1.

The lid 2 in the right side of the drawing is intended to form the upper side of the device and fumes are sucked in through the opening 3 in this lid and flow downwards behind the partition wall 11 and out through the lid 4 having a mounted exhaust tube 5. Thus, this exhaust tube 5 is connected to some kind of fan which blows the fumes into some kind of purification plant. In the drawing, the course of the fumes is shown with unfilled arrows. The direction of the heat radiation from the device is shown with filled arrows.

Figure 3:
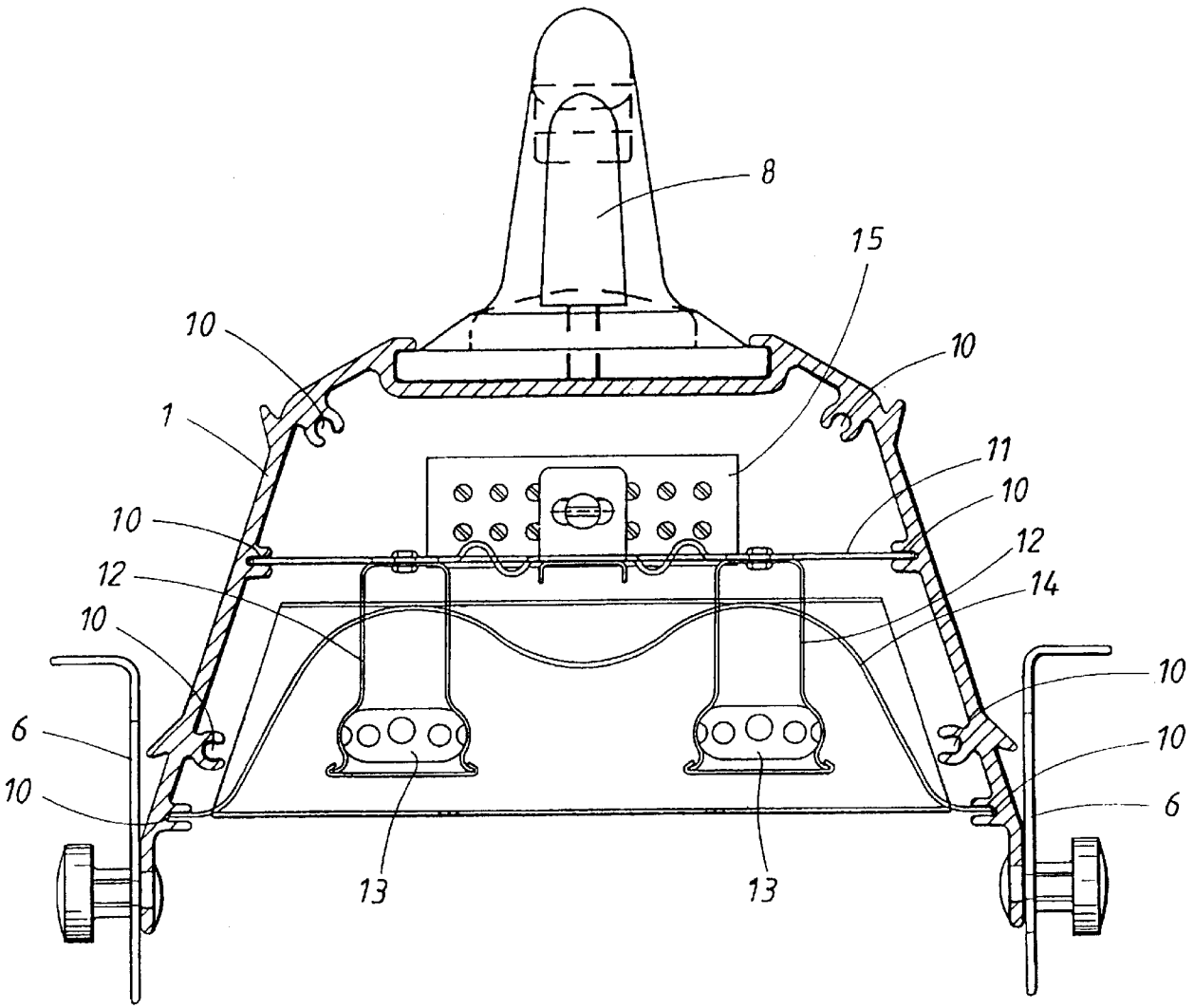
FIG. 3 is horizontal section of the device according to the invention.

FIG. 3 shows a horizontal section through the device according to the invention, from which drawing the location of the partition wall 11 and the reflector 14 is apparent. Due to the fact that two wire elements 13 are provided, the reflector 14 has obtained a wave-form which guarantees a concentrated radiation of the surface. As is apparent from the drawing, a plate 15 for electric devices is provided on the partition wall 11 and on the backside of this.

As is apparent, the handle unit 8 is inserted downwards in tracks on the outside of the main component 1, and two distance holders 6 are fastened with screws on each side of the opening of the main component 1 towards the side surface being treated.

Figure 4:
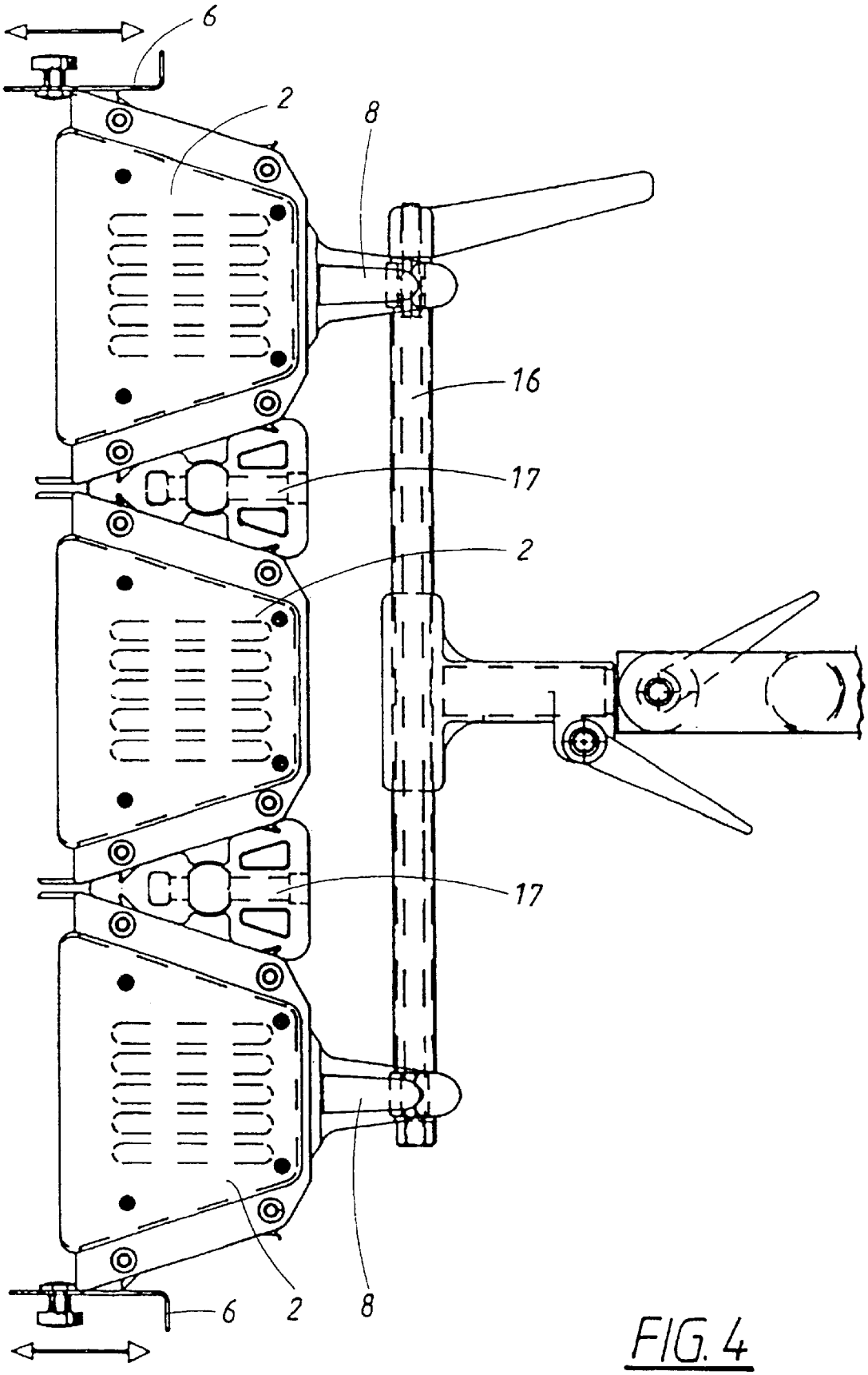
FIG. 4 is a top view of a mounting of three of the devices according to the present invention on a common carrier.

FIG. 4 shows three devices according to the invention being coupled together to form one single unit. The two outermost devices are provided with handle units 8 and are attached to a bar 16 which in turn is mounted on a manoeuvrable arm. The devices according to the invention are shown from above and are thus only shown through the upper lids 2. Due to the fact that the devices widen out towards the opening, two intermediate pieces 17 have been used in order to attach the various parts to each other. Of course, only one radiation device can also be used.

Thus, by means of the present invention, a very simple and quickly assembled device for radiation has been provided, wherein it has been possible to construct said device so that it is very light, it is mounted on an easily manoeuvred member, and so that it can be connected to a suction device which makes the device harmless to the environment. The surface which has been radiated by means of the device according to the invention, which radiation can take place within a period of a few minutes, is subsequently scraped off and cleaned in a very simple manner.

The invention is not limited to the embodiment which is described above, but may be varied within the scope of the appended claims.

What is claimed is:

1. A device for providing heat radiation to a surface comprising:

a main component having first and second sides and first and second end portions, said main component including an opening at said first side of said main component adapted to face said surface;

longitudinally extending tracks disposed within said main component;

a longitudinally extending partition wall disposed within said main component and having a first side facing said opening in said main component and a second side forming a space behind said partition wall at said second side of said main component;

a plurality of electrical resistance wires arranged longitudinally in said main component on said first side of said partition wall;

a first lid disposed at said first end portion of said main component, said first lid including an exhaust opening which communicates with said space; and a second lid disposed at said second end portion of said main component, said second lid including a suction opening which communicates with said space, wherein fumes are sucked in through said suction opening, forced through said space and exhausted through said exhaust opening.

2. The device according to claim 1, wherein said partition wall supports said plurality of electrical resistance wires.

3. The device according to claim 2, wherein said partition wall is disposed in said longitudinally extending tracks.

4. The device according to claim 3, further comprising a wave-like shaped reflector disposed in said longitudinally extending tracks between said plurality of resistance wires and said partition wall.

5. The device according to claim 4, further comprising first and second displaceable walls located on either said of said opening.

6. A plurality of devices according to claim 5, coupled together to provide an elongated radiation surface.

7. The device according to claim 5, further comprising:

additional longitudinally extending tracks disposed on the exterior of said second side of said main component; and a handle unit mounted in said additional longitudinally extending tracks.

8. The device according to claim 5, wherein said main component is formed by a method selected from the group consisting of extrusion pressing, casting and injection molding.

9. The device according to claim 1, further comprising a reflector disposed in said longitudinally extending tracks between said plurality of electrical resistance wires and said partition wall.

10. The device according to claim 9, wherein said reflector is wave-like in shape.

11. The device according to claim 1, further comprising first and second adjustable distance holders located at said first side, wherein said first and second adjustable distance holders are displaceable walls and said first adjustable holder is located towards said first end and said second adjustable holder is located towards said second end.

12. A plurality of devices according to claim 1, coupled together to provide an elongated radiation surface.

13. The device according to claim 1, further comprising:

additional longitudinally extending tracks disposed on the exterior of said second side of said main component; and a handle unit mounted in said additional longitudinally extending tracks.

14. The device according to claim 1, wherein said main component is formed by a method selected from the group consisting of extrusion pressing, casting and injection molding.

15. A device for providing heat radiation to a surface comprising:

a main component having first and second sides and first and second end portions, said main component including an opening at said first side of said main component adapted to face said surface;

a plurality of electrical resistance wires arranged longitudinally in said main component;

longitudinally extending tracks disposed within said main component;

a longitudinally extending partition wall disposed within said main component and by a first said facing said opening in said main component and a second side forming a space behind said partition wall at said second side of said main component, said longitudinally extending partition wall inserted into said longitudinally extending tracks, said partition wall supporting said plurality of electrical resistance wires;

a first lid disposed at said first end portion of said main component, said first lid including an exhaust opening which communicates with said space;

a second lid disposed at said second end portion of said main component, said second lid including a suction opening which communicates with said space, wherein fumes are sucked in through said suction opening, forced through said space and exhausted through said exhaust opening;

a wave-like shaped reflector disposed in said longitudinally extending tracks between said plurality of electrical resistance wires and said partition wall;

first and second displaceable walls located on either side of said opening;

additional longitudinally extending tracks disposed on the exterior of said second side of said main component; and a handle unit mounted in said additional longitudinally extending tracks.

16. A plurality of devices according to claim 15, coupled together to produce an elongated radiation surface.

17. The device according to claim 16, wherein said main component is formed by a method selected from the group consisting of extrusion pressing, casting and injection molding.

18. The device according to claim 15, wherein said main component is formed by a method selected from the group consisting of extrusion pressing, casting and injection molding.

* * * * *